US008395613B2

(12) United States Patent
Okamoto et al.

(10) Patent No.: US 8,395,613 B2
(45) Date of Patent: Mar. 12, 2013

(54) DISPLAY APPARATUS AND DRIVING METHOD THEREOF

(75) Inventors: Kaoru Okamoto, Chiba (JP); Jun Sumioka, Yokohama (JP); Tadahiko Hirai, Caulfield (AU)

(73) Assignee: Canon Kabushiki Kaisha, Tokyo (JP)

( * ) Notice: Subject to any disclaimer, the term of this patent is extended or adjusted under 35 U.S.C. 154(b) by 924 days.

(21) Appl. No.: 12/493,784

(22) Filed: Jun. 29, 2009

(65) Prior Publication Data

US 2010/0007656 A1 Jan. 14, 2010

(30) Foreign Application Priority Data

Jul. 10, 2008 (JP) ..... 2008-180212

(51) Int. Cl.
*G09G 5/00* (2006.01)

(52) U.S. Cl. ..... 345/214; 345/77

(58) Field of Classification Search ..... 345/76–83, 345/204–215

See application file for complete search history.

(56) References Cited

U.S. PATENT DOCUMENTS

| | | | | |
|---|---|---|---|---|
| 6,774,578 | B2 | 8/2004 | Tanada | 315/169.4 |
| 6,903,516 | B2 | 6/2005 | Tanada | 315/169.4 |
| 7,053,874 | B2 | 5/2006 | Koyama | 345/82 |
| 7,268,499 | B2 | 9/2007 | Tanada | 315/169.3 |
| 7,280,705 | B1 * | 10/2007 | Frank et al. | 382/274 |
| 7,437,013 | B2 * | 10/2008 | Anderson | 382/261 |
| 7,483,058 | B1 * | 1/2009 | Frank et al. | 348/222.1 |
| 8,243,820 | B2 * | 8/2012 | Holcomb et al. | 375/240.25 |
| 2006/0202924 | A1 | 9/2006 | Koyama | 345/76 |
| 2008/0170007 | A1 | 7/2008 | Tanada | 345/76 |
| 2008/0297056 | A1 | 12/2008 | Hirai | |
| 2009/0002356 | A1 | 1/2009 | Sumioka et al. | |

FOREIGN PATENT DOCUMENTS

| | | |
|---|---|---|
| JP | 2002-169511 | 6/2002 |
| JP | 2002-175041 | 6/2002 |
| JP | 2006-018130 A | 1/2006 |

* cited by examiner

*Primary Examiner* — Vijay Shankar

(74) *Attorney, Agent, or Firm* — Fitzpatrick, Cella, Harper & Scinto

(57) ABSTRACT

A display apparatus includes a plurality of pixels disposed in a matrix pattern, each of the pixels emitting light, an acquisition unit for acquiring degradation characteristics of an emission luminance of each pixel from a video signal or a signal output from the pixel, and a detection unit for detecting a boundary of pixels showing different degradation characteristics of the plurality of pixels based on the degradation characteristics acquired by the acquisition unit. A calculation unit calculates a correction amount of the video signal to the pixels in a periphery of the boundary such that the emission luminance is gently varied in the periphery of the boundary when the plurality of pixels in the periphery of the boundary detected by the detection unit are caused to emit light with a same video signal. In addition, a correction unit corrects the video signal based on the calculated correction amount, and a video image is displayed by the plurality of pixels based on the corrected video signal.

7 Claims, 22 Drawing Sheets

FIG. 3

MEMORY
507

| | | | | | | | | | | | | | | | | | | | |
|---|---|---|---|---|---|---|---|---|---|---|---|---|---|---|---|---|---|---|---|
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |

602
DEGRADATION CHARACTERISTIC

FIG. 4

MEMORY
507

| | | | | | | | | | | | | | | | | | | | |
|---|---|---|---|---|---|---|---|---|---|---|---|---|---|---|---|---|---|---|---|
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 90 | 90 | 90 | 90 | 90 | 90 | 90 | 90 | 90 | 90 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |

602
DEGRADATION CHARACTERISTIC

FIG. 5

PIXEL REGION
111

| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 100 | 100 | 100 | 100 | 100 | 100 | 100 | 100 | 100 | 100 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

FIG. 6

PIXEL REGION
111

| | | | | | | | | | | | | | | | | | | | | | |
|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 80 | 80 | 80 | 80 | 80 | 80 | 80 | 80 | 80 | 80 | 80 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 7

| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | -10 | -20 | -30 | -30 | -30 | -30 | -30 | -30 | -30 | -30 | -20 | -10 | 0 | 0 | 0 | 0 |
| 0 | 0 | 0 | 0 | -20 | 50 | 30 | 30 | 30 | 30 | 30 | 30 | 30 | 30 | 50 | -20 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -30 | 30 | 0 | 0 | 0 | 0 | 0 | 0 | 0 | 0 | 30 | -30 | 0 | 0 | 0 | 0 |
| 0 | 0 | 0 | 0 | -20 | 50 | 30 | 30 | 30 | 30 | 30 | 30 | 30 | 30 | 50 | -20 | 0 | 0 | 0 | 0 |
| 0 | 0 | 0 | 0 | -10 | -20 | -30 | -30 | -30 | -30 | -30 | -30 | -30 | -30 | -20 | -10 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

FIG. 8

| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | -1 | -3 | -4 | -4 | -4 | -4 | -4 | -4 | -4 | -4 | -3 | -1 | 0 | 0 | 0 | 0 |
| 0 | 0 | 0 | 0 | -3 | 6 | 4 | 4 | 4 | 4 | 4 | 4 | 4 | 4 | 6 | -3 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -4 | 4 | 0 | 0 | 0 | 0 | 0 | 0 | 0 | 0 | 4 | -4 | 0 | 0 | 0 | 0 |
| 0 | 0 | 0 | 0 | -3 | 6 | 4 | 4 | 4 | 4 | 4 | 4 | 4 | 4 | 6 | -3 | 0 | 0 | 0 | 0 |
| 0 | 0 | 0 | 0 | -1 | -3 | -4 | -4 | -4 | -4 | -4 | -4 | -4 | -4 | -3 | -1 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

FIG. 9

A

B

| | | | | | | | | | | | | | | | | | | | |
|---|---|---|---|---|---|---|---|---|---|---|---|---|---|---|---|---|---|---|---|
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 80 | 80 | 80 | 80 | 80 | 80 | 80 | 80 | 80 | 80 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |

FIG. 10

| | | | | | | | | | | | | | | | | | | | | |
|---|---|---|---|---|---|---|---|---|---|---|---|---|---|---|---|---|---|---|---|---|
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| A | 100 | 100 | 100 | 100 | 100 | 90 | 90 | 90 | 90 | 90 | B | 90 | 90 | 90 | 90 | 100 | 100 | 100 | 100 | 100 |
| | 100 | 100 | 100 | 100 | 100 | 90 | 90 | 90 | 90 | 90 | | 90 | 90 | 90 | 90 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| | 100 | 100 | 100 | 100 | 100 | 90 | 90 | 90 | 90 | 90 | 90 | 90 | 90 | 90 | 90 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |

FIG. 11

| | | | | | | | | | | | | | | | | | | | | |
|---|---|---|---|---|---|---|---|---|---|---|---|---|---|---|---|---|---|---|---|---|
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 99 | 98 | 96 | 96 | 96 | 96 | 96 | 96 | 96 | 96 | 98 | 99 | 100 | 100 | 100 | 100 |
| | 100 | 100 | 100 | 100 | 98 | 96 | 94 | 94 | 94 | 94 | 94 | 94 | 94 | 94 | 96 | 98 | 100 | 100 | 100 | 100 |
| | 100 | 100 | 100 | 100 | 96 | 94 | 90 | 90 | 90 | 90 | 90 | 90 | 90 | 90 | 94 | 96 | 100 | 100 | 100 | 100 |
| | 100 | 100 | 100 | 100 | 96 | 94 | 90 | 90 | 90 | 90 | 90 | 90 | 90 | 90 | 94 | 96 | 100 | 100 | 100 | 100 |
| | 100 | 100 | 100 | 100 | 96 | 94 | 90 | 90 | 90 | 90 | 90 | 90 | 90 | 90 | 94 | 96 | 100 | 100 | 100 | 100 |
| A | 100 | 100 | 100 | 100 | 96 | 94 | 90 | 90 | 90 | 90 | B | 90 | 90 | 90 | 94 | 96 | 100 | 100 | 100 | 100 |
| | 100 | 100 | 100 | 100 | 96 | 94 | 90 | 90 | 90 | 90 | | 90 | 90 | 90 | 94 | 96 | 100 | 100 | 100 | 100 |
| | 100 | 100 | 100 | 100 | 96 | 94 | 90 | 90 | 90 | 90 | 90 | 90 | 90 | 90 | 94 | 96 | 100 | 100 | 100 | 100 |
| | 100 | 100 | 100 | 100 | 96 | 94 | 90 | 90 | 90 | 90 | 90 | 90 | 90 | 90 | 94 | 96 | 100 | 100 | 100 | 100 |
| | 100 | 100 | 100 | 100 | 96 | 94 | 90 | 90 | 90 | 90 | 90 | 90 | 90 | 90 | 94 | 96 | 100 | 100 | 100 | 100 |
| | 100 | 100 | 100 | 100 | 98 | 96 | 94 | 94 | 94 | 94 | 94 | 94 | 94 | 94 | 96 | 98 | 100 | 100 | 100 | 100 |
| | 100 | 100 | 100 | 100 | 99 | 98 | 96 | 96 | 96 | 96 | 96 | 96 | 96 | 96 | 98 | 99 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |
| | 100 | 100 | 100 | 100 | 100 | 100 | 100 | 100 | 100 | 100 | 100 | 100 | 100 | 100 | 100 | 100 | 100 | 100 | 100 | 100 |

FIG. 19

DISPLAY 201

| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 100 | 100 | 100 | 100 | 0 | 0 | 0 | 0 | 0 | 0 | 0 | 0 |
| 0 | 0 | 0 | 0 | 0 | 0 | 0 | 100 | 100 | 100 | 100 | 100 | 100 | 0 | 0 | 0 | 0 | 0 | 0 | 0 |
| 0 | 0 | 0 | 0 | 0 | 0 | 100 | 100 | 100 | 100 | 100 | 100 | 100 | 100 | 0 | 0 | 0 | 0 | 0 | 0 |
| 0 | 0 | 0 | 0 | 0 | 100 | 100 | 100 | 100 | 0 | 0 | 100 | 100 | 100 | 100 | 0 | 0 | 0 | 0 | 0 |
| 0 | 0 | 0 | 0 | 100 | 100 | 100 | 100 | 0 | 0 | 0 | 0 | 100 | 100 | 100 | 100 | 0 | 0 | 0 | 0 |
| 0 | 0 | 0 | 100 | 100 | 100 | 100 | 0 | 0 | 0 | 0 | 0 | 0 | 100 | 100 | 100 | 100 | 0 | 0 | 0 |
| 0 | 0 | 0 | 100 | 100 | 100 | 0 | 0 | 0 | 0 | 0 | 0 | 0 | 0 | 100 | 100 | 100 | 0 | 0 | 0 |
| 0 | 0 | 0 | 100 | 100 | 100 | 0 | 0 | 0 | 0 | 0 | 0 | 0 | 0 | 100 | 100 | 100 | 0 | 0 | 0 |
| 0 | 0 | 0 | 100 | 100 | 100 | 100 | 100 | 100 | 100 | 100 | 100 | 100 | 100 | 100 | 100 | 100 | 0 | 0 | 0 |
| 0 | 0 | 0 | 100 | 100 | 100 | 100 | 100 | 100 | 100 | 100 | 100 | 100 | 100 | 100 | 100 | 100 | 0 | 0 | 0 |
| 0 | 0 | 0 | 100 | 100 | 100 | 100 | 100 | 100 | 100 | 100 | 100 | 100 | 100 | 100 | 100 | 100 | 0 | 0 | 0 |
| 0 | 0 | 0 | 100 | 100 | 100 | 0 | 0 | 0 | 0 | 0 | 0 | 0 | 0 | 100 | 100 | 100 | 0 | 0 | 0 |
| 0 | 0 | 0 | 100 | 100 | 100 | 0 | 0 | 0 | 0 | 0 | 0 | 0 | 0 | 100 | 100 | 100 | 0 | 0 | 0 |
| 0 | 0 | 0 | 100 | 100 | 100 | 0 | 0 | 0 | 0 | 0 | 0 | 0 | 0 | 100 | 100 | 100 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

202 PIXEL

FIG. 20

DISPLAY 201

| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 90 | 90 | 90 | 90 | 0 | 0 | 0 | 0 | 0 | 0 | 0 | 0 |
| 0 | 0 | 0 | 0 | 0 | 0 | 0 | 90 | 90 | 90 | 90 | 90 | 90 | 0 | 0 | 0 | 0 | 0 | 0 | 0 |
| 0 | 0 | 0 | 0 | 0 | 0 | 90 | 90 | 90 | 90 | 90 | 90 | 90 | 90 | 0 | 0 | 0 | 0 | 0 | 0 |
| 0 | 0 | 0 | 0 | 0 | 90 | 90 | 90 | 90 | 0 | 0 | 90 | 90 | 90 | 90 | 0 | 0 | 0 | 0 | 0 |
| 0 | 0 | 0 | 0 | 90 | 90 | 90 | 90 | 0 | 0 | 0 | 0 | 90 | 90 | 90 | 90 | 0 | 0 | 0 | 0 |
| 0 | 0 | 0 | 90 | 90 | 90 | 90 | 0 | 0 | 0 | 0 | 0 | 0 | 90 | 90 | 90 | 90 | 0 | 0 | 0 |
| 0 | 0 | 0 | 90 | 90 | 90 | 0 | 0 | 0 | 0 | 0 | 0 | 0 | 0 | 90 | 90 | 90 | 0 | 0 | 0 |
| 0 | 0 | 0 | 90 | 90 | 90 | 0 | 0 | 0 | 0 | 0 | 0 | 0 | 0 | 90 | 90 | 90 | 0 | 0 | 0 |
| 0 | 0 | 0 | 90 | 90 | 90 | 90 | 90 | 90 | 90 | 90 | 90 | 90 | 90 | 90 | 90 | 90 | 0 | 0 | 0 |
| 0 | 0 | 0 | 90 | 90 | 90 | 90 | 90 | 90 | 90 | 90 | 90 | 90 | 90 | 90 | 90 | 90 | 0 | 0 | 0 |
| 0 | 0 | 0 | 90 | 90 | 90 | 90 | 90 | 90 | 90 | 90 | 90 | 90 | 90 | 90 | 90 | 90 | 0 | 0 | 0 |
| 0 | 0 | 0 | 90 | 90 | 90 | 0 | 0 | 0 | 0 | 0 | 0 | 0 | 0 | 90 | 90 | 90 | 0 | 0 | 0 |
| 0 | 0 | 0 | 90 | 90 | 90 | 0 | 0 | 0 | 0 | 0 | 0 | 0 | 0 | 90 | 90 | 90 | 0 | 0 | 0 |
| 0 | 0 | 0 | 90 | 90 | 90 | 0 | 0 | 0 | 0 | 0 | 0 | 0 | 0 | 90 | 90 | 90 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

302
DEGRADED PIXEL

FIG. 21

DISPLAY 201

| | | | | | | | | | | | | | | | | | | | |
|---|---|---|---|---|---|---|---|---|---|---|---|---|---|---|---|---|---|---|---|
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 90 | 90 | 90 | 90 | 100 | 100 | 100 | 100 | 100 | 100 | 100 | 100 |
| 100 | 100 | 100 | 100 | 100 | 100 | 100 | 90 | 90 | 90 | 90 | 90 | 90 | 100 | 100 | 100 | 100 | 100 | 100 | 100 |
| 100 | 100 | 100 | 100 | 100 | 100 | 90 | 90 | 90 | 90 | 90 | 90 | 90 | 90 | 100 | 100 | 100 | 100 | 100 | 100 |
| 100 | 100 | 100 | 100 | 100 | 90 | 90 | 90 | 90 | 100 | 100 | 90 | 90 | 90 | 90 | 100 | 100 | 100 | 100 | 100 |
| 100 | 100 | 100 | 100 | 90 | 90 | 90 | 90 | 100 | 100 | 100 | 100 | 90 | 90 | 90 | 90 | 100 | 100 | 100 | 100 |
| 100 | 100 | 100 | 90 | 90 | 90 | 90 | 100 | 100 | 100 | 100 | 100 | 100 | 90 | 90 | 90 | 90 | 100 | 100 | 100 |
| 100 | 100 | 100 | 90 | 90 | 90 | 100 | 100 | 100 | 100 | 100 | 100 | 100 | 100 | 90 | 90 | 90 | 100 | 100 | 100 |
| 100 | 100 | 100 | 90 | 90 | 90 | 100 | 100 | 100 | 100 | 100 | 100 | 100 | 100 | 90 | 90 | 90 | 100 | 100 | 100 |
| 100 | 100 | 100 | 90 | 90 | 90 | 90 | 90 | 90 | 90 | 90 | 90 | 90 | 90 | 90 | 90 | 90 | 100 | 100 | 100 |
| 100 | 100 | 100 | 90 | 90 | 90 | 90 | 90 | 90 | 90 | 90 | 90 | 90 | 90 | 90 | 90 | 90 | 100 | 100 | 100 |
| 100 | 100 | 100 | 90 | 90 | 90 | 90 | 90 | 90 | 90 | 90 | 90 | 90 | 90 | 90 | 90 | 90 | 100 | 100 | 100 |
| 100 | 100 | 100 | 90 | 90 | 90 | 100 | 100 | 100 | 100 | 100 | 100 | 100 | 100 | 90 | 90 | 90 | 100 | 100 | 100 |
| 100 | 100 | 100 | 90 | 90 | 90 | 100 | 100 | 100 | 100 | 100 | 100 | 100 | 100 | 90 | 90 | 90 | 100 | 100 | 100 |
| 100 | 100 | 100 | 90 | 90 | 90 | 100 | 100 | 100 | 100 | 100 | 100 | 100 | 100 | 90 | 90 | 90 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 | 100 | 100 | 100 | 100 | 100 | 100 | 100 | 100 |

302 DEGRADED PIXEL

DISPLAY APPARATUS AND DRIVING METHOD THEREOF

BACKGROUND OF THE INVENTION

1. Field of the Invention

The present invention relates to a self-emission type display apparatus and a driving method thereof, particularly to a technology of correcting burn-in of an organic EL display.

2. Description of the Related Art

Recently, an electronic device using an organic semiconductor material is widely developed, and developments on an organic EL (electroluminescence) that is a light emitting device, an organic TFT (thin film transistor), an organic solar cell, and the like are reported. Among others, the organic EL display is a promising technology closest to practical use. The organic EL display includes a number of organic EL devices, and the number of organic EL devices are disposed in a matrix pattern. In self-emission devices such as the organic EL device, emission luminance of each organic EL device is lowered according to a light emission amount or a light emission time. The lowering of the emission luminance is caused by degradation of emission characteristics. When the degradation of the emission characteristics is progressed, the organic EL device emits the light with different luminance according to the light emission amount or light emission time even if the driving conditions are identical.

In the organic EL display having the above-described emission characteristics, sometimes a phenomenon called "burn-in" is generated when a portion having the large difference in luminance is fixed for a long period of time on the display. When the burn-in is generated, because a burn-in image remains even if another image is displayed, the images overlap each other, thereby posing a problem that the display screen becomes difficult to see.

For example, when movie display is performed, a probability of generating burn-in is low because a same image is seldom continuously displayed for a long period of time at a same place of the display.

However, when a same icon is displayed over a long period of time in a viewfinder of a digital still camera or a digital camcorder, because a same image is always continuously displayed for a long period of time at a same place, the burn-in is easy to generate.

FIGS. 19 to 21 illustrate an example of the burn-in phenomenon. A display 201 of FIG. 19 includes 20 monochrome pixels 202 in the vertical direction by 20 monochrome pixels 202 in the horizontal direction, and a value of each pixel 202 indicates a relative value of emission luminance (hereinafter referred to as luminance value). In the example of FIG. 19, a letter "A" is displayed on the display 201 using the pixels having luminance value of 100. When the letter of FIG. 21 is continuously displayed for a long period of time at the same place, the pixels displayed for the long period of time are degraded, for example, the luminance value is decreased to 90 to become a degraded pixel 302 as illustrated in FIG. 20.

Then, the display 201 including the degraded pixels 302 is changed from the letter "A" to full pixel display in which all the pixels are displayed with the maximum luminance. At this point, as illustrated in FIG. 21, the luminance value becomes 90 only in the degraded pixel 302 used to display the letter "A" while other pixels have the luminance value of 100. Therefore, the portion of the letter "A" becomes adversely dark and the letter "A" is profiled.

In order to keep the burn-in phenomenon inconspicuous, for example, the following technologies have been disclosed.

In a technology disclosed in Japanese Patent Application Laid-Open No. 2002-175041, a cumulative light emission time of each pixel or the cumulative light emission time and emission luminance of each pixel are counted from an original video signal and stored in a memory. Based on correction data previously stored in a correction data memory, a correction circuit corrects the video signal from the cumulative light emission time or the cumulative light emission time and emission luminance, which are stored in the memory, according to a degree of degradation of each self-emission device. Therefore, a luminance variance can be eliminated to obtain a uniform image screen even for a burn-in phenomenon in which the self-emission device is degraded in part of the pixels.

In a technology disclosed in Japanese Patent Application Laid-Open No. 2002-169511, a specific test pattern is displayed when the power is turned on, the luminance is detected by a photoelectric conversion device disposed in each pixel, and the luminance is stored in a storage circuit. Then, a correction circuit corrects an original video signal according to a deficit from a standard luminance (previously stored luminance of a normal self-emission device at the same gradation), and a video image is displayed in the display apparatus.

In the technology disclosed in Japanese Patent Application Laid-Open No. 2002-175041, it is necessary to previously obtain a relationship among the cumulative light emission time of each pixel, a cumulative value of the emission luminance of each pixel, and the degree of degradation of each self-emission device. However, it is difficult to correctly obtain the relationship from only the information on the video signal.

For example, in the organic EL device, a relationship between the emission luminance and an emission luminance half-value time is expressed by Expression 1:

$$\frac{t_1}{t_2} = \left(\frac{L_1}{L_2}\right)^{-n} \qquad \text{(Expression 1)}$$

In the above expression, $L_1$ and $L_2$ are emission luminances, $t_1$ is an emission luminance half-value time of the emission luminance $L_1$, $t_2$ is an emission luminance half-value time of the emission luminance $L_2$, and n is an acceleration coefficient. That is, the degree of degradation is varied when the emission luminance, that is, the gradation is varied. Furthermore, the acceleration coefficient n is not always kept constant for the emission luminance. Additionally, in consideration to the variation of the degree of degradation due to an environmental temperature or a drive temperature, even if the relationship among the cumulative light emission time, the cumulative value of the emission luminance, and the degree of degradation of each self-emission device is previously obtained, there may be posed a problem that a deviation in degree of degradation is generated between the previously obtained value and each device of the actually used display apparatus.

In the correction technology disclosed in Japanese Patent Application Laid-Open No. 2002-169511, in which the luminance is detected, although the variation of a current-luminance characteristic of the organic EL device can be corrected, it is necessary to prepare a photoelectric conversion device in each pixel in addition to the organic EL device. Accordingly, when the correction technology disclosed in Japanese Patent Application Laid-Open No. 2002-169511 is applied to a high-resolution display, there may be posed a problem that the photoelectric conversion device cannot be disposed in the individual pixel, or an aperture ratio that is a light emitting region is lowered.

Furthermore, because the correction method in which the luminance is detected is influenced by a fluctuation of the characteristic of the photoelectric conversion device in each pixel or a characteristic variation, there is a problem that the burn-in less than the fluctuation of the characteristic of the photoelectric conversion device is hardly corrected.

SUMMARY OF THE INVENTION

In accordance with a first aspect of the invention, there is provided a display apparatus which includes a plurality of pixels disposed in a matrix pattern, each of the pixels emitting light; an acquisition unit for acquiring degradation characteristics of an emission luminance of the pixel from a video signal or a signal output from the pixel; a detection unit for detecting a boundary of pixels showing different degradation characteristics of the plurality of pixels based on the degradation characteristics acquired by the acquisition unit; a calculation unit for calculating a correction amount of the video signal to the pixels in a periphery of the boundary such that the emission luminance is gently varied in the periphery of the boundary when the plurality of pixels in the periphery of the boundary detected by the detection unit are caused to emit light with a same video signal; and a correction unit for correcting the video signal based on the correction amount calculated by the calculation unit, wherein a video image is displayed by the plurality of pixels based on the corrected video signal.

In accordance with a second aspect of the invention, there is provided a display apparatus driving method of driving a display apparatus that includes a plurality of pixels and displays a video image using the plurality of pixels, each of the plurality of pixels emitting light, the plurality of pixels being disposed in a matrix pattern, the method includes the acquisition step of acquiring degradation characteristics of an emission luminance of the pixel from a video signal or a signal output from the pixel; the detection step of detecting a boundary of pixels showing different degradation characteristics of the plurality of pixels based on the acquired degradation characteristics; the calculation step of calculating a correction amount of the video signal to the pixels in a periphery of the boundary such that the emission luminance is gently varied in the periphery of the boundary when the plurality of pixels in the periphery of the detected boundary are caused to emit light with a same video signal; the correction step of correcting the video signal based on the calculated correction amount; and the display step of displaying the video image in the plurality of pixels based on the corrected video signal.

The invention can provide a driving method in which, even if the burn-in phenomenon is generated in the display apparatus, the video image can be displayed while making the burn-in phenomenon inconspicuous. Therefore, the lifetime of the display apparatus can be lengthened.

Further features of the present invention will become apparent from the following description of exemplary embodiments with reference to the attached drawings.

BRIEF DESCRIPTION OF THE PREFERRED DRAWINGS

FIG. 3 is a diagram schematically illustrating a memory of the burn-in correction portion of the first embodiment of the present invention when the memory is in an initial state.

FIG. 4 is a diagram schematically illustrating a memory of the burn-in correction portion of the first embodiment of the present invention when a 10-by-10 pixel in a central portion of the display apparatus is displayed for a long period of time to thereby cause degradation.

FIG. 5 is a diagram illustrating emission luminance before degradation when a 10-by-10 pixel in a central portion of a 20-by-20-pixel display apparatus is displayed for a long period of time.

FIG. 6 is a diagram illustrating emission luminance after degradation when the 10-by-10 pixel in the central portion of the 20-by-20-pixel display apparatus has been displayed for a long period of time.

FIG. 7 is a diagram illustrating operation result of a boundary portion detection circuit according to the first or second embodiment of the present invention.

FIG. 8 is a diagram illustrating operation result of a correction amount operation circuit according to the first or second embodiment of the present invention.

FIG. 9 is a diagram illustrating a luminance distribution when all pixels are allowed to emit light after the 10-by-10 pixel in the central portion of the 20-by-20-pixel display apparatus is displayed for a long period of time to thereby cause degradation.

FIG. 10 is a diagram illustrating a luminance distribution when correction using a conventional technology is made and all pixels are allowed to emit light after the 10-by-10 pixel in the central portion of the 20-by-20-pixel display apparatus has been displayed for a long period of time to thereby cause the degradation.

FIG. 11 is a diagram illustrating a luminance distribution when correction by an embodiment of the present invention is made and all pixels are allowed to emit light after the 10-by-10 pixel in the central portion of the 20-by-20-pixel display apparatus has been displayed for a long period of time to thereby cause the degradation.

Figure 12:
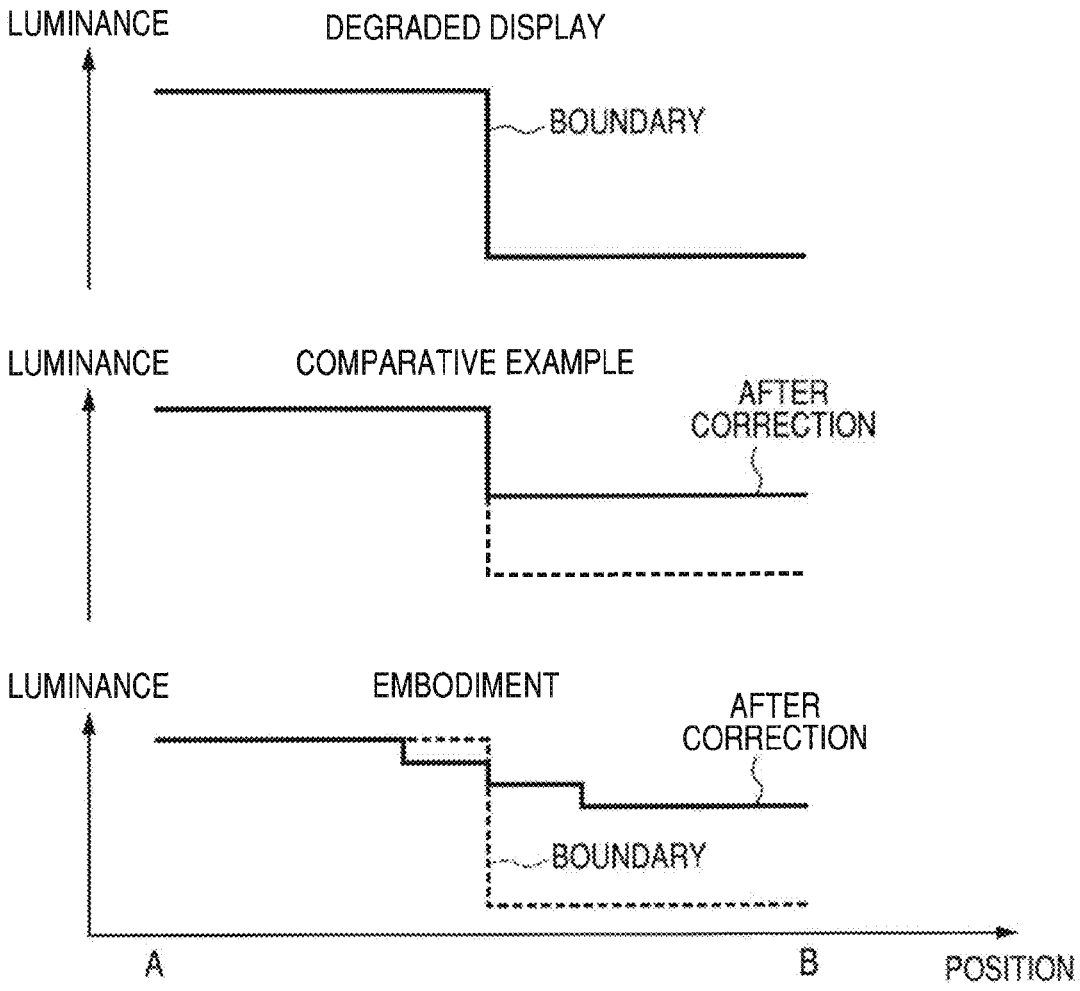

FIG. 12 is a diagram illustrating luminance distributions by comparison in the case where correction is not made and all pixels are allowed to emit light after the 10-by-10 pixel in the central portion of the 20-by-20-pixel display apparatus has been displayed for a long period of time to thereby cause the degradation, the case where correction using a conventional technology is made and all pixels are allowed to emit light after the 10-by-10 pixel in the central portion of the 20-by-20-pixel display apparatus has been displayed for a long period of time to thereby cause the degradation, and the case where correction with an embodiment of the present invention is made and all pixels are allowed to emit light after the 10-by-10 pixel in the central portion of the 20-by-20-pixel display apparatus has been displayed for a long period of time to thereby cause the degradation.

Figure 13:
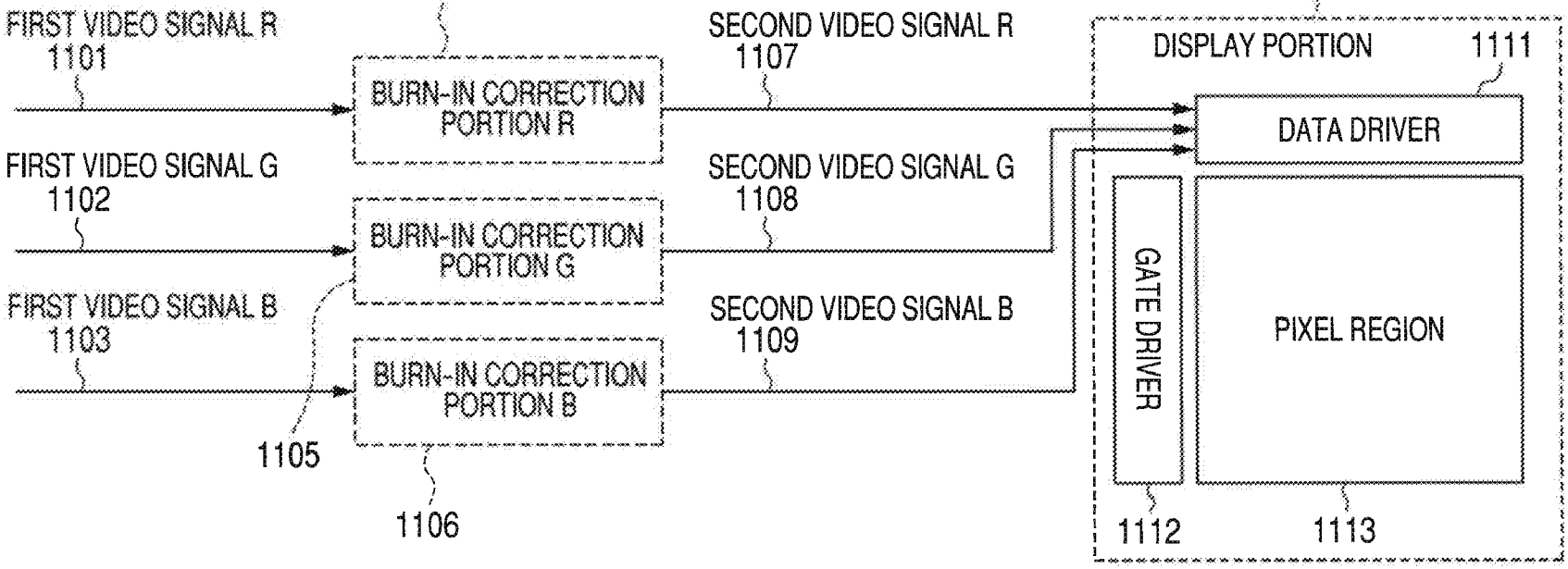

FIG. 13 is a diagram illustrating another configuration of the first embodiment of the present invention.

Figure 14:
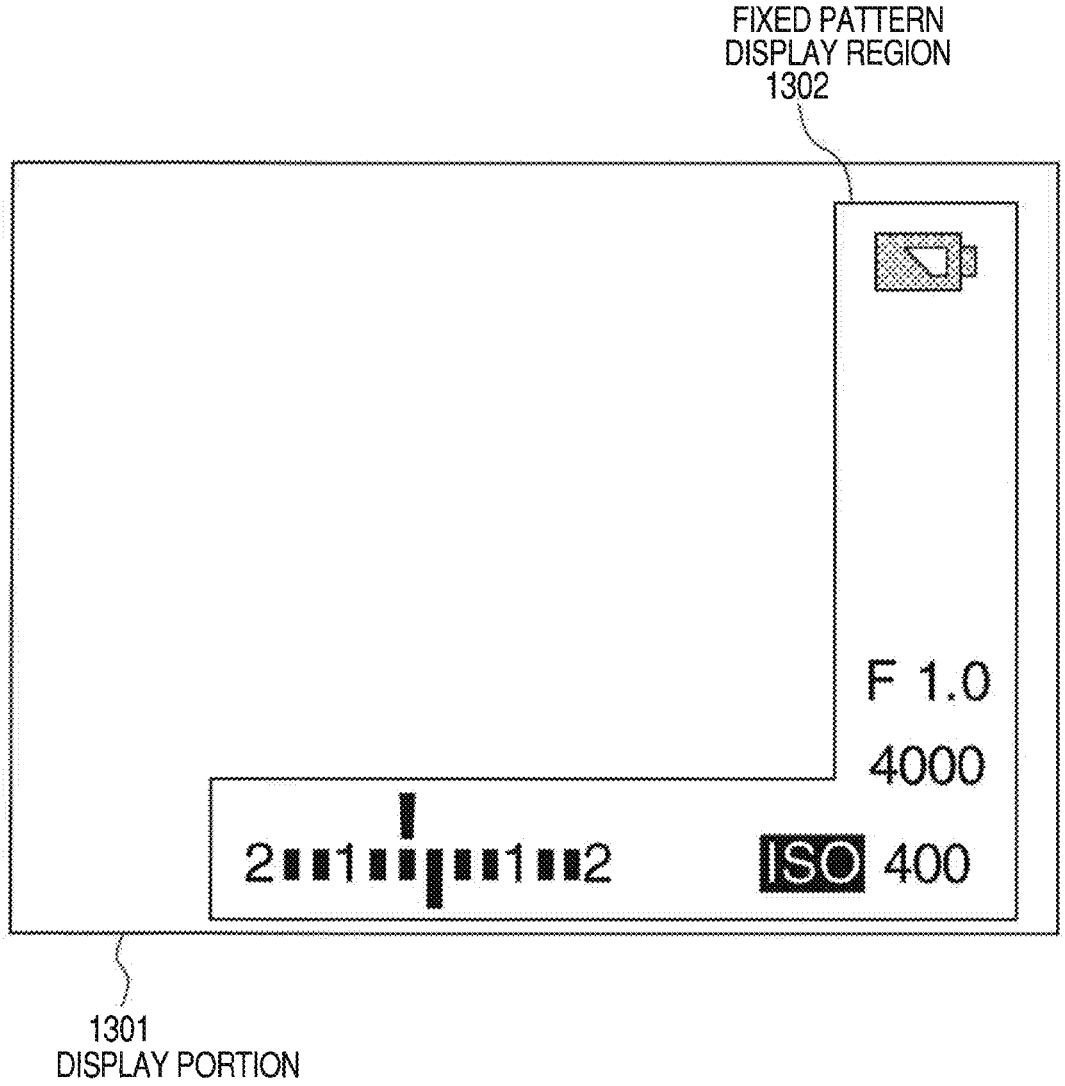

FIG. 14 is a view explaining a fixed pattern display region of the first embodiment of the present invention.

Figure 15:
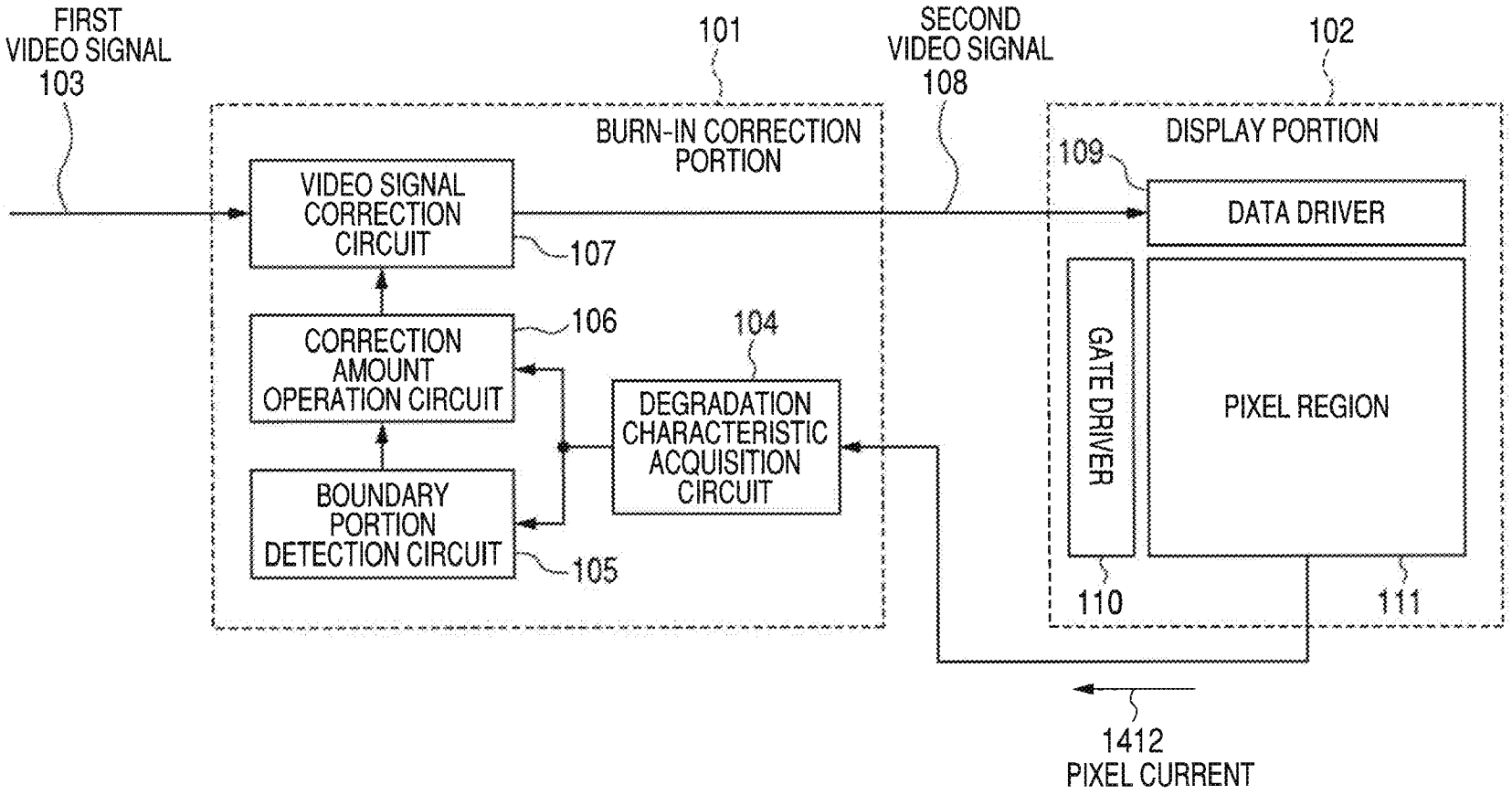

FIG. 15 is a block diagram illustrating a schematic configuration of a display apparatus according to a second embodiment of the present invention.

Figure 16:
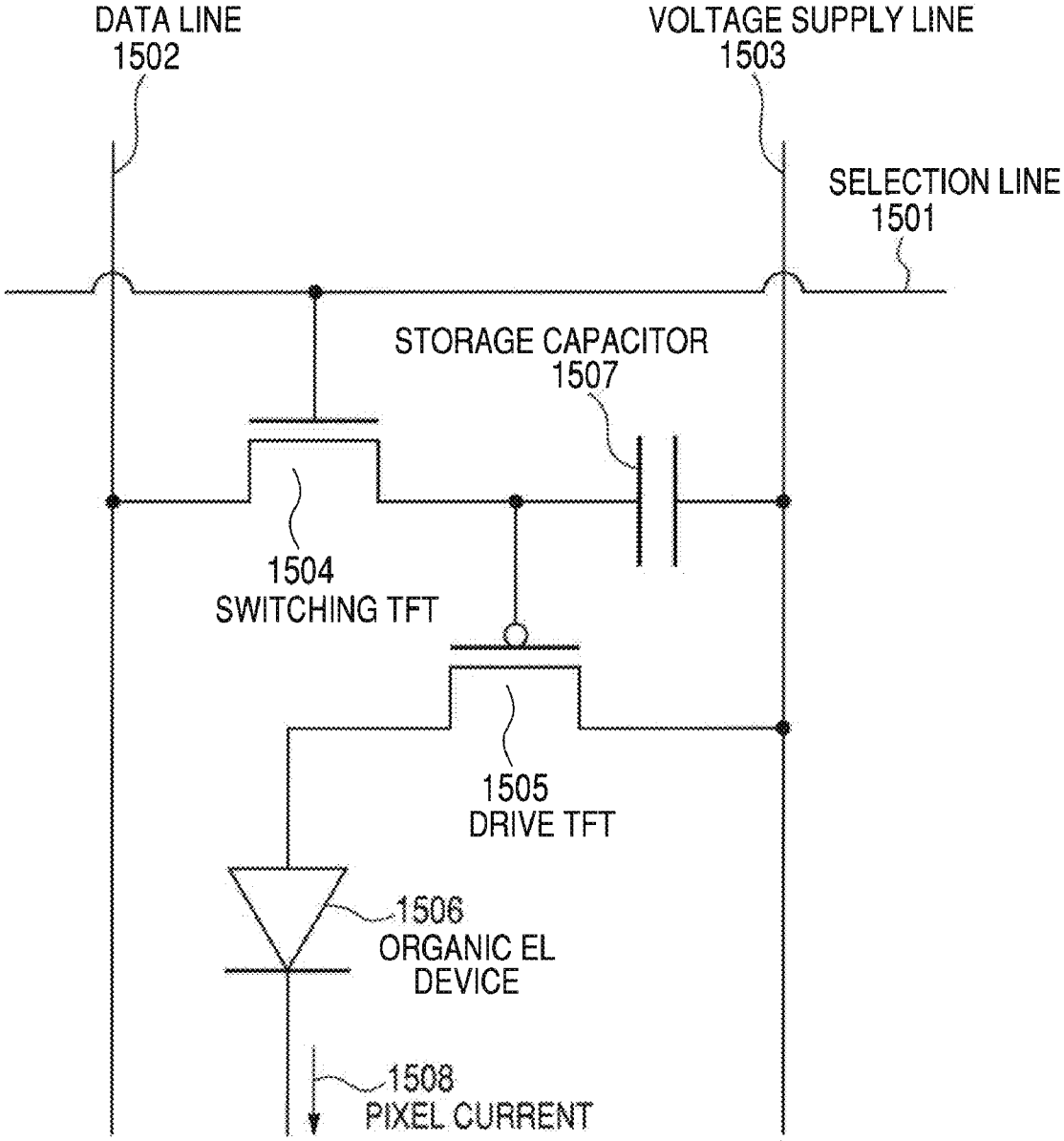

FIG. 16 is a diagram illustrating a pixel circuit of the second embodiment of the present invention.

Figure 17:
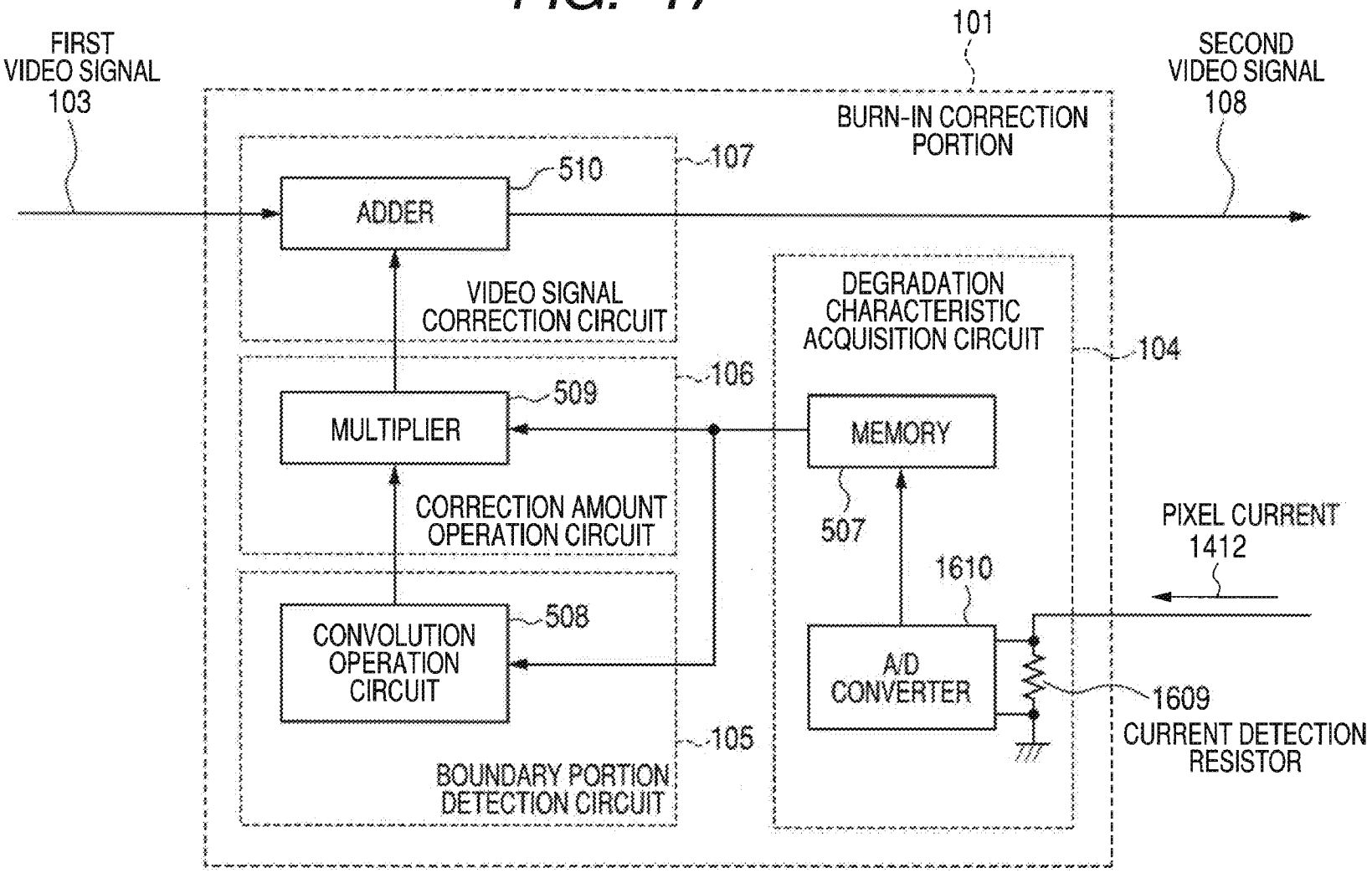

FIG. 17 is a block diagram illustrating a burn-in correction portion of the second embodiment of the present invention.

Figure 18:
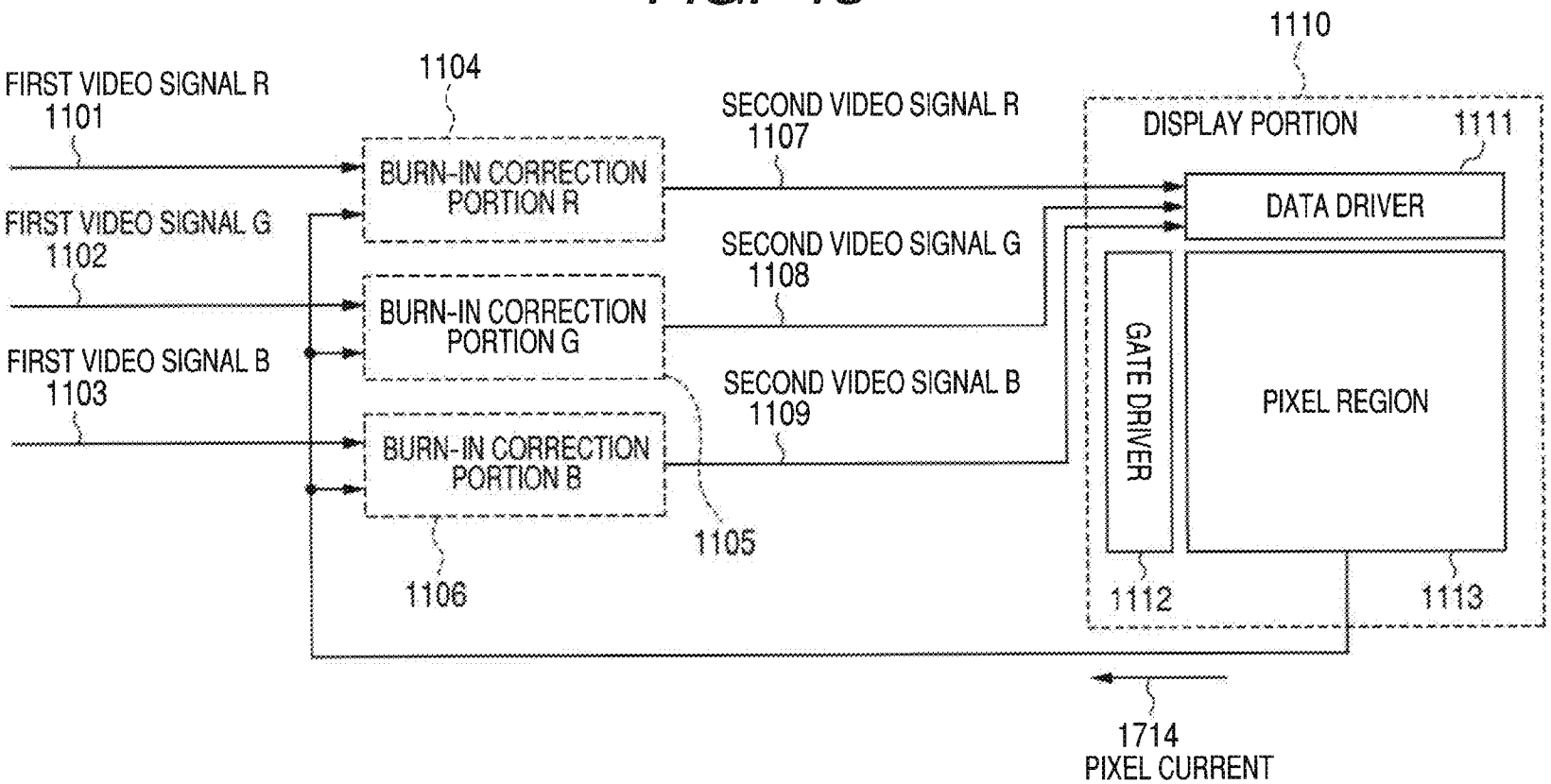

FIG. 18 is a diagram illustrating another configuration of the second embodiment of the present invention.

FIG. 19 is a diagram schematically illustrating the case in which a letter "A" is displayed in a 20-by-20-pixel display apparatus.

FIG. 20 is a diagram schematically illustrating the case in which the letter "A" is displayed in the 20-by-20-pixel display apparatus for a long period of time to thereby cause degradation.

FIG. 21 is a diagram schematically illustrating the case in which all pixels are allowed to emit light after the letter "A" has been displayed for a long period of time in the 20-by-20-pixel display apparatus to thereby cause the degradation.

Figure 22:
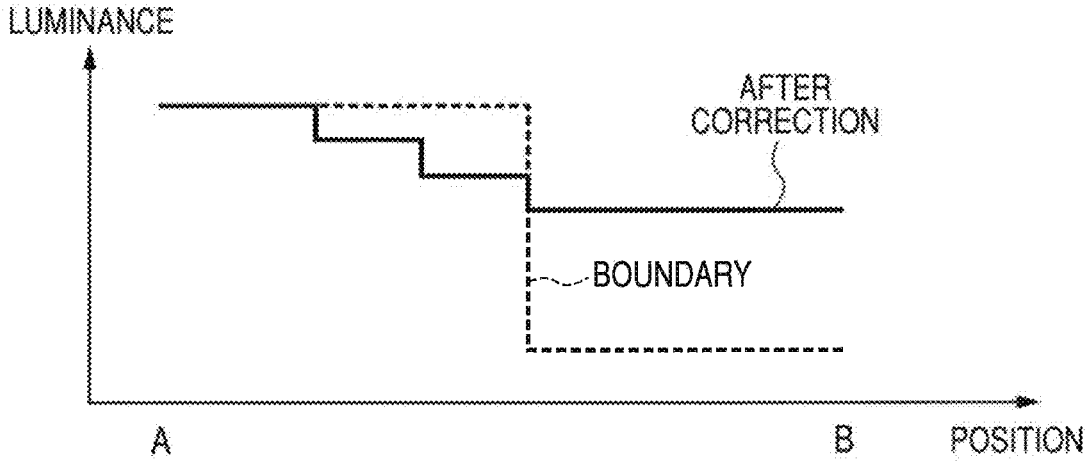

FIG. 22 is a diagram illustrating a luminance distribution when another correction by an embodiment of the present invention is made and all pixels are allowed to emit light after the 10-by-10 pixel in the central portion of the 20-by-20-pixel display apparatus has been displayed for a long period of time to thereby cause the degradation.

Figure 23:
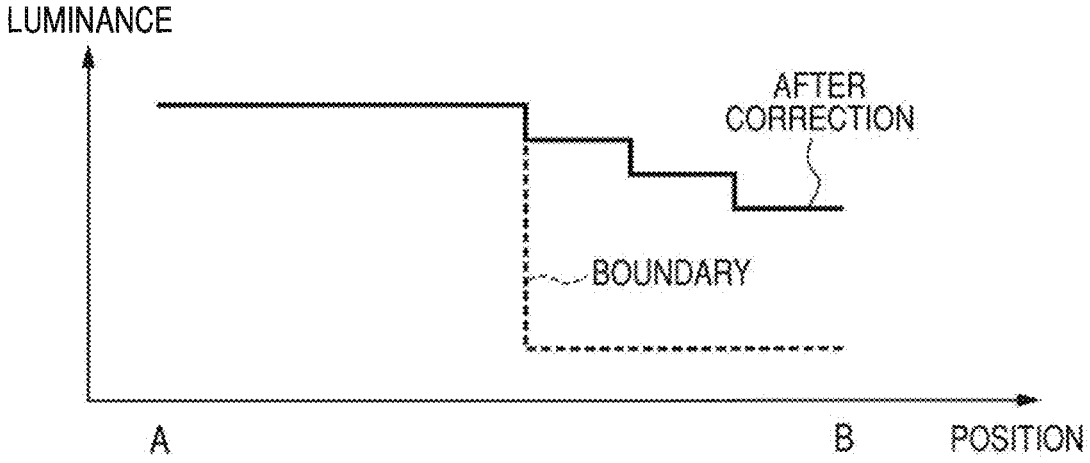

FIG. 23 is a diagram illustrating a luminance distribution when another correction by an embodiment of the present invention is made and all pixels are allowed to emit light after the 10-by-10 pixel in the central portion of the 20-by-20-pixel display apparatus has been displayed for a long period of time to thereby cause the degradation.

DESCRIPTION OF THE PREFERRED EMBODIMENTS

Exemplary embodiments of the present invention will be described below with reference to the drawings.

(First Embodiment)

Figure 1:
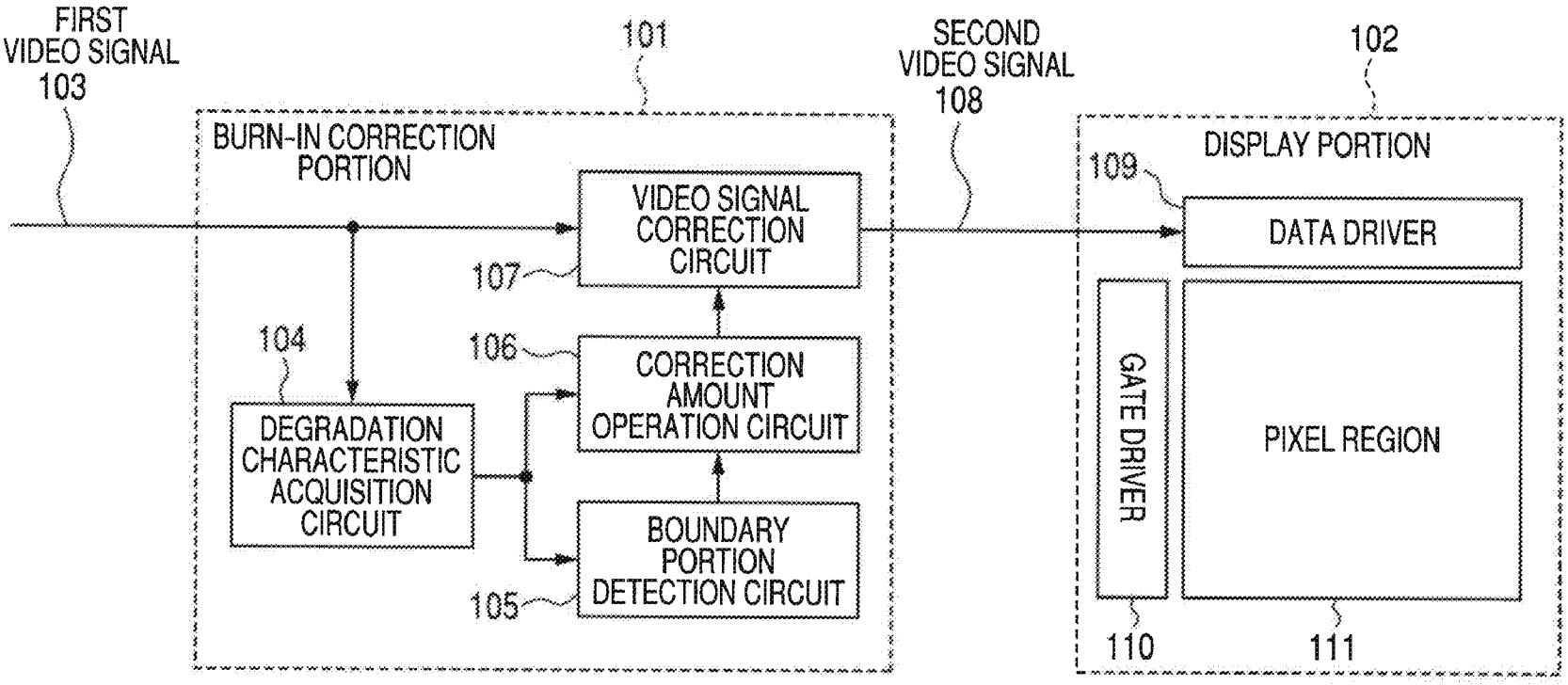
FIG. 1 is a block diagram illustrating a schematic configuration of a display apparatus according to a first embodiment of the present invention.

FIG. 1 is a block diagram illustrating a schematic configuration of a display apparatus according to a first embodiment of the present invention. The display apparatus of the first embodiment includes a burn-in correction portion 101 and a display portion 102. The burn-in correction portion 101 converts a first video signal 103 into a second video signal 108, and the second video signal 108 is input to the display portion 102. Then, the second video signal 108 is input to a data driver 109, and the data driver 109 causes each pixel of a pixel region 111 to emit light. A self-emission type display, such as an organic EL display and a plasma display, in which each pixel emits the light, can be used as the display portion 102. In the first embodiment, the organic EL display is used as the display portion 102. Like reference numerals are employed to refer to like elements in the respective figures.

Although not illustrated in FIG. 1, the display apparatus also includes a power supply circuit and a timing control circuit in addition to the burn-in correction portion 101 and the display portion 102. The power supply circuit supplies a power to the data driver 109 and a gate driver 110. The timing control circuit performs timing control to the gate driver 110 and the data driver 109. A signal processing circuit may be added to the burn-in correction portion 101 in order to perform video signal correction such as data rearrangement, color correction and gamma correction.

The burn-in correction portion 101 includes a degradation characteristic acquisition circuit 104, a boundary portion detection circuit 105, a correction amount operation circuit 106, and a video signal correction circuit 107. The degradation characteristic acquisition circuit 104 counts a light emission time and an emission luminance of each pixel of the pixel region 111 from the first video signal 103, and the light emission time and the emission luminance are stored as degradation characteristics therein. The boundary portion detection circuit 105 detects a degraded boundary from the degradation characteristics of each pixel. The correction amount operation circuit 106 arithmetically operates a correction amount based on the information on the degraded boundary, and transmits the correction amount to the video signal correction circuit 107.

The degradation characteristic acquisition circuit 104 constitutes the acquisition unit, the video signal correction circuit 107 constitutes the correction unit, the boundary portion detection circuit 105 constitutes the detection unit, and the correction amount operation circuit 106 constitutes the calculation unit.

In the first embodiment, the boundary of the emission luminance is detected, and the correction amounts of the video signals of the pixels in the periphery of the boundary such that the emission luminance is gently varied in the periphery of the boundary as illustrated in FIG. 12. In FIG. 12, the emission luminance is varied while three luminance value steps are provided. The number of steps is appropriately set such that a difference in luminance caused by the burn-in becomes inconspicuous. Furthermore, the width of the boundary region is also appropriately set such that the difference in luminance caused by the burn-in becomes inconspicuous.

In FIG. 12, a region in a periphery of the outside and inside of the pixel region is set to the region in the periphery of the boundary for the boundary of the pixel showing the different degradation characteristics in the pixel region 111, and the video signal is corrected in the region in the periphery of the boundary. Alternatively, as illustrated in FIG. 22, a region in a periphery of the outside of the pixel region from the boundary of the pixel is set to the region in the periphery of the boundary, and the video signal of the pixel may be corrected in the region. Alternatively, as illustrated in FIG. 23, a region in a periphery of the inside of the pixel region from the boundary of the pixel is set to the region in the periphery of the boundary, and the video signal of the pixel may be corrected in the region.

Figure 2:
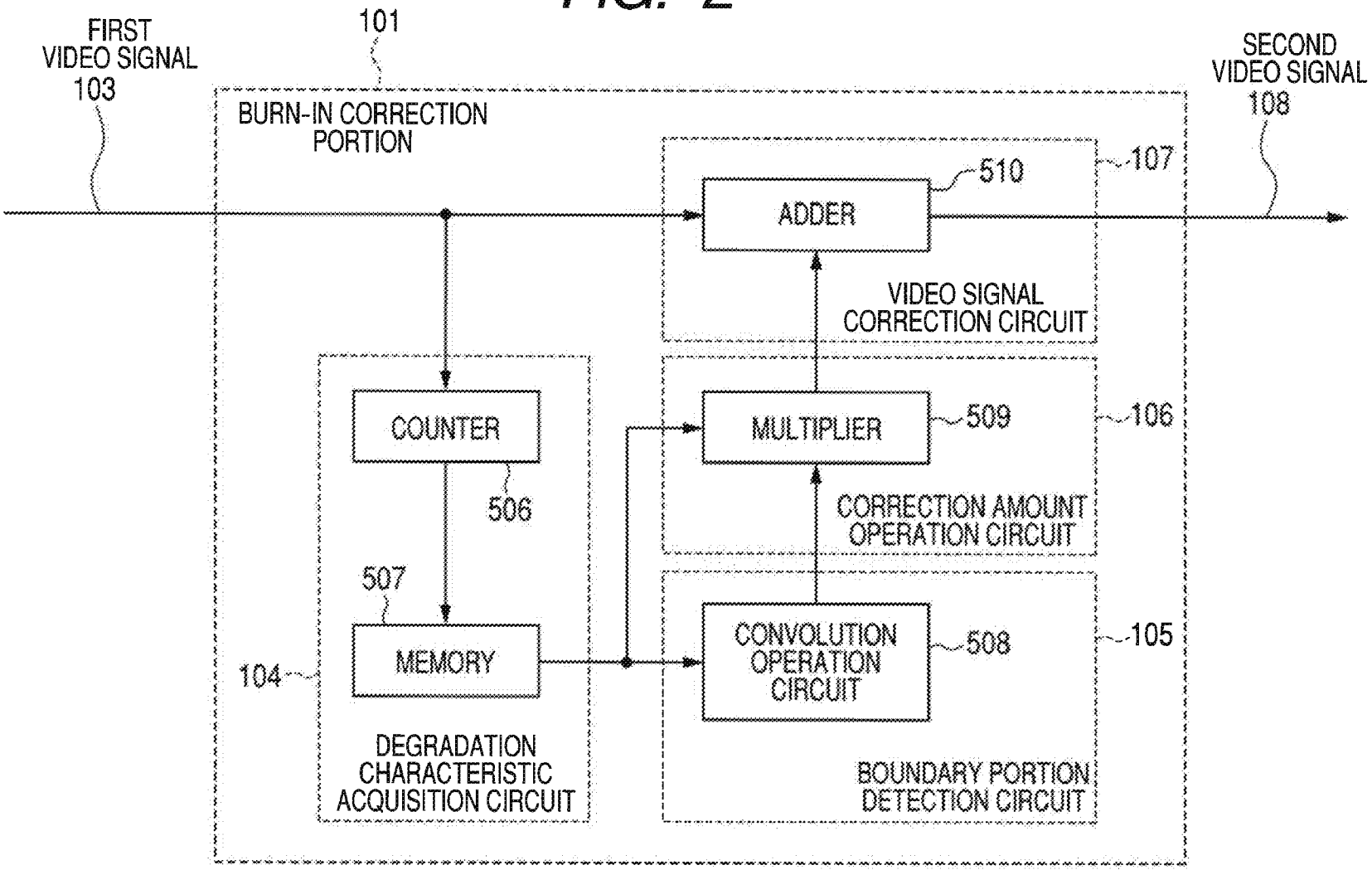
FIG. 2 is a block diagram illustrating a burn-in correction portion of the first embodiment of the present invention.

A burn-in correction operation will be described with reference to FIG. 2. FIG. 2 illustrates the detailed burn-in correction portion. The address and degradation information of each pixel are stored in a memory 507. FIG. 3 schematically illustrates the addresses and degradation characteristics of a 20-by-20 pixel in the memory 507. Each numerical value indicates the degradation characteristics of each pixel, and an initial value is set to 100.

A counter 506 counts the light emission time and emission luminance of each pixel from the first video signal 103, and updates the degradation characteristics stored in the memory 507. For example, as illustrated in FIG. 5, when a square fixed pattern is displayed in a central portion of the pixel region 111 of the display portion 102 with the luminance value of 100, the counter 506 updates the memory 507 according to a display time.

In the central portion of the pixel region 111 of the display portion 102, it is assumed that the fixed pattern is displayed until the luminance value is decreased from 100 to 80 as illustrated in FIG. 6. However, as described above, a deviation is generated in the relationship among the cumulative light emission time, the cumulative value of the emission luminance, and the degree of degradation of each light emitting device, and sometimes the degradation characteristics are not correctly updated in the memory 507. In degradation characteristics 602 stored in the memory 507, it is assumed that the initial value is decreased from 100 to 90 as illustrated in FIG. 4.

Then, the boundary portion detection circuit 105 will be described. In the first embodiment, a convolution operation circuit 508 performs a convolution operation in order to detect the boundary portion. An eight-direction Laplacian filter which obtains a second derivative expressed by Expression 2 is used to detect the boundary portion.

$$\begin{pmatrix} 1 & 1 & 1 \\ 1 & -8 & 1 \\ 1 & 1 & 1 \end{pmatrix} \quad \text{(Expression 2)}$$

The filter used to detect the boundary portion is not limited to the Laplacian filter, but filters such as a Prewitt filter and a Sobel filter may be used as long as it can detect an edge. The Laplacian filter, the Prewitt filter, and the Sobel filter are used to obtain the boundary (edge) of the degradation characteristics. The Prewitt filter and the Sobel filter arithmetically operate a first derivative (difference) of the degradation characteristics with an adjacent pixel, and the Laplacian filter arithmetically operates the second derivative.

Although the filter having the order of 3×3 is used in the first embodiment, the filter having the order of 5×5 or 7×7 may also be selected according to a size of the display or a burn-in pattern.

The convolution operation is performed to the degradation characteristics 602 in the memory 507 using the Laplacian filter. The following operation is performed by the convolution operation circuit 508. Assuming that (x,y) is an address of the memory 507 and F(x,y) is degradation characteristics 602, result G(x,y) of the convolution operation performed using the filter expressed by Expression 3 becomes Expression 4:

$$\begin{pmatrix} a & b & c \\ d & e & f \\ g & h & i \end{pmatrix} \quad \text{(Expression 3)}$$

$$G(x, y) = \left\{ \begin{matrix} a \cdot F(x-1, y-1) + b \cdot F(x, y-1) + \\ c \cdot F(x+1, y-1) + d \cdot F(x-1, y) + \\ e \cdot F(x, y) + f \cdot F(x, +1, y) + \\ g \cdot F(x-1, y+1) + h \cdot F(x-1, y-1) + \\ i \cdot F(x-1, y+1) \end{matrix} \right\} \Big/ \{a+b+c+d+e+f+g+h+i\} \quad \text{(Expression 4)}$$

FIG. 7 illustrates result of the convolution operation actually performed to the data in the memory 507 of FIG. 4. It can be confirmed from the result of FIG. 7 that the boundary portion of the central portion in which the burn-in phenomenon is generated can be detected. The convolution operation is not performed to the outermost peripheral pixels in the 20-by-20 pixel, and the degradation characteristics are set to zero.

Then, the correction amount operation circuit 106 will be described. In the first embodiment, only a multiplier 509 is used. The result of the convolution operation of FIG. 7 is multiplied by ⅛, and the product is rounded into an integer. FIG. 8 illustrates the rounded result. In the present embodiment, the multiplier is used and the constant is set to ⅛. Alternatively, the change in multiplication constant or another operation may be performed according to the degradation characteristics of the display or intensity of the burn-in correction. The correction amount operation circuit 106 corrects the deficit value of 10 caused by the degradation of the central portion in the memory 507 of FIG. 4 by the method similar to the technology disclosed in Japanese Patent Application Laid-Open No. 2002-175041. Finally, in the video signal correction circuit 107, the first video signal 103 is corrected with the adder 510 and converted into the second video signal 108. In the present embodiment, a simple adder is used as the video signal correction circuit 107.

As shown in FIG. 6, when all the pixels in which the burn-in phenomenon is generated in the central portion are allowed to emit light with the luminance value of 100, the luminance value becomes 80 only in the degraded pixels in the central portion of FIG. 9 while the luminance value becomes 100 in other pixels, so that a square shape is profiled in the central portion. When the central portion is corrected using the technology disclosed in Japanese Patent Application Laid-Open No. 2002-175041, the correction is not correctly made when the deviation is generated in the relationship among the cumulative light emission time, the cumulative value of the emission luminance, and the degree of degradation of each light emitting device. Therefore, as illustrated in FIG. 10, the central portion becomes dark, and the square shape is profiled in the central portion.

However, in the present embodiment, the burn-in correction portion 101 corrects the burn-in, and the display is performed as shown in FIG. 11. FIG. 12 illustrates the luminances between the pixels A and B of FIGS. 9 to 11 by comparison in the case where the degraded device is not corrected (FIG. 9), the case where the correction is made by the technology disclosed in Japanese Patent Application Laid-Open No. 2002-175041 (FIG. 10) (Comparative Example), and the case where the correction of the present embodiment is made (FIG. 11).

In the correction of the present embodiment, as shown in FIG. 12, because the edge of the portion in which the burn-in phenomenon is generated is smoothed compared with the correction made by the technology disclosed in Japanese Patent Application Laid-Open No. 2002-175041 (Comparative Example), the square shape becomes inconspicuous when the display apparatus is actually viewed.

Although a monochrome panel is employed in the present embodiment, the actual color display includes a plurality of colors such as RGB and RGBW. Therefore, as illustrated in FIG. 13, a burn-in correction portions R1104, G1105, and B1106 may be provided for each emission color. The burn-in correction portions R1104, G1105, and B1106 have configurations similar to that of the burn-in correction portion of FIG. 2. A first video signal R1101, a first video signal G1102, and a first video signal B1103 are input to the burn-in correction portion R1104, the burn-in correction portion G1105, and the burn-in correction portion B1106, respectively. A second video signal R1107, a second video signal G1108, and a second video signal B1109 that are respectively output from the burn-in correction portion R1104, the burn-in correction portion G1105, and the burn-in correction portion B1106 are input to a data driver 1111 of a display portion 1110. The data driver 1111 causes each pixel of a pixel region 1113 to emit light.

Furthermore, when the burn-in is easy to generate for a specific color, the burn-in correction portion may be provided only for the specific color. In such cases, because a circuit scale of the burn-in correction portion is decreased, the production cost can be reduced. For example, when the color display includes RGB colors (red, green, and blue), the burn-in correction portion is not provided for each of the RGB colors, but the burn-in correction portion may be provided for one or two colors.

(Second Embodiment)

FIG. 15 is a block diagram illustrating a schematic configuration of a display apparatus according to a second embodiment of the invention. In the second embodiment, the burn-in correction portion 101 corrects the first video signal 103 based on a pixel current 1412 from the pixel region 111. In other words, the display apparatus of the second embodiment differs from the display apparatus of the first embodiment in that the degradation characteristic acquisition circuit 104 detects the pixel current 1412 that is a current passing through each pixel by a voltage applied to the pixel and stores the pixel current 1412 as the degradation characteristics. The display apparatus of the second embodiment will be described while a point in which it is different from that of the first embodiment is centered.

FIG. 16 illustrates a pixel circuit of each pixel. Each pixel includes two transistors, that is, a switching TFT 1504 and a drive TFT 1505. In one frame interval, the switching TFT 1504 is turned on in a selection interval during which a selection line 1501 becomes a high level, and a predetermined voltage is applied to a data line 1502, thereby programming the predetermined voltage in a storage capacitor 1507. The storage capacitor 1507 is connected to a gate of the drive TFT 1505. In one frame interval, the drive TFT 1505 is driven according to the programmed voltage in a non-selection interval during which the selection line 1501 becomes a low level, and a pixel current 1508 passes from a voltage supply line 1503 to an organic EL device 1506.

Although the active-matrix type display apparatus having the two transistors is used in the present embodiment, the number of transistors is not limited to two as long as the pixel current 1508 is passing through the organic EL device 1506. Further, a passive-matrix type display apparatus may be used.

A burn-in correction operation will be described with reference to FIG. 17. FIG. 17 illustrates the detailed burn-in correction portion 101 of the present embodiment. A current detection resistor 1609 converts the pixel current 1412 into a voltage, and an A/D converter 1610 digitizes the voltage to store the digital value in the memory 507. The amount of current passing through each pixel is measured by sequentially applying a voltage to the pixels disposed in the matrix pattern. When the driving TFT 1505 or organic EL device 1506 is degraded in each pixel, because the measured current amount is varied even if the identical voltage is applied to the pixels, the variation of the current amount can be used as the degradation characteristics.

When the amount of current passing through the pixel is decreased, the emission luminance of the organic EL device is decreased. On the other hand, when the emission luminance is varied to a certain current amount by the decreased burn-in, because the current amount to be increased is unclear, the correction is not correctly made.

As with the memory 507 of the first embodiment illustrated in FIG. 3, the address and the degradation information of each pixel are stored in the memory 507 of the present embodiment. That is, as shown in FIG. 3, the addresses and degradation characteristics of the 20-by-20 pixel are stored in the memory 507 of the present embodiment. In FIG. 3, the numerical value indicates the degradation characteristics of each pixel, and the initial value is set to 100. The amount of current passing from the A/D converter 1610 to each pixel is measured to update the degradation characteristics of the memory 507.

For example, as with the pixel region 111 of FIG. 5, when the square fixed pattern is displayed with the luminance value of 100 in the central portion of the pixel region 111, the A/D converter 1610 updates the memory 507 according to the decrease in pixel current 1412 associated with the degradation of the pixel. As with the first embodiment, as illustrated in FIG. 6, it is assumed that the fixed pattern is displayed until the luminance value is decreased from 100 to 80.

However, when the emission luminance is varied to a certain current amount by the burn-in phenomenon, the deviation is generated between the degradation characteristics and the current amount, and it is assumed that the degradation characteristics 602 in the memory 507 becomes a value, which is not an actual value, for example, 90 like the memory 507 of FIG. 4.

As with the first embodiment, the convolution operation is performed using the Laplacian filter in order to detect the boundary portion. FIG. 7 illustrates the result of the convolution operation. It can be confirmed from the result of FIG. 7 that the boundary portion of the central portion in which the burn-in phenomenon is generated can be detected. The convolution operation is not performed to the outermost peripheral pixels in the 20-by-20 pixel, and the degradation characteristics are set to zero.

As with the first embodiment, the result of the convolution operation of FIG. 7 is multiplied by ⅛, and the product is rounded into an integer. The correction amount operation circuit 106 corrects the deficit value of 10 caused by the degradation of the central portion in the memory 507 by the method similar to the technology disclosed in Japanese Patent Application Laid-Open No. 2002-175041. Finally, in the video signal correction circuit 107, the first video signal 103 is corrected with the adder 510 and converted into the second video signal 108. In the present embodiment, the simple adder is used as the video signal correction circuit 107.

As shown in FIG. 6, when all the pixels in which the burn-in phenomenon is generated in the central portion are allowed to emit light with the luminance value of 100, the luminance value becomes 80 only in the degraded pixels in the central portion of FIG. 9 while the luminance value becomes 100 in other pixels, and thereby the square shape is profiled in the central portion. When the central portion is corrected using the technology disclosed in Japanese Patent Application No. 2002-175041, the correction is not correctly made when the deviation is generated in the relationship among the cumulative light emission time, the cumulative value of the emission luminance, and the degree of degradation of each light emitting device. Therefore, as shown in FIG. 10, the central portion becomes dark, and the square shape is profiled in the central portion.

However, in the present embodiment, the burn-in correction portion 101 corrects the burn-in, and the display is performed as illustrated in FIG. 11. FIG. 12 illustrates the luminances between the pixels A and B of FIGS. 9 to 11 by comparison in the case where the degraded device is not corrected (FIG. 9), the case where the correction is made by the technology disclosed in Japanese Patent Application Laid-Open No. 2002-175041 (FIG. 10) (Comparative Example), and the case where the correction of the present embodiment is made (FIG. 11).

In the correction of the present embodiment, as shown in FIG. 12, the edge of the portion in which the burn-in phenomenon is generated is smoothed compared with the correction made by the technology disclosed in Japanese Patent Application Laid-Open No. 2002-175041 (Comparative Example), so that the square shape becomes inconspicuous when the display apparatus is actually viewed.

Although a monochrome panel is used in the present embodiment, the actual color display includes a plurality of colors such as RGB and RGBW. Therefore, as illustrated in FIG. 18, the burn-in correction portions R1104, G1105, and B1106 may be provided for each emission color. The burn-in correction portions R1104, G1105, and B1106 have configurations similar to that of the burn-in correction portion of FIG. 17.

When the burn-in is easy to generate in a specific color, the burn-in correction portion may be provided only for the specific color. In such cases, because a circuit scale of the burn-in correction portion is decreased, the production cost can also be reduced.

In the first and the second embodiments, it is not always necessary that the memory 507 and the operation circuit are provided for all the pixels. For example, in the case of the use in which the fixed pattern display region 1302 exists in the display portion 1301 as illustrated in FIG. 14, the memory 507 and the operation circuit may be provided only in the portion corresponding to the fixed pattern display region 1302. By this configuration, the circuit scale of the burn-in correction portion is decreased, and the cost can be reduced as with the above-mentioned case.

Furthermore, the burn-in correction portion can be operated by a program. For example, the burn-in correction portion includes CPU and ROM in which the program describing the operation of the burn-in correction portion is stored, and CPU can execute the program to realize the function of the burn-in correction portion. The burn-in correction portion operated by the program is also included in the technical scope of the invention.

In the above, the case where the Laplacian filter is used to arithmetically operate the second derivative to thereby detect the boundary portion has been specifically described. However, also in the case where the first derivative (difference) is arithmetically operated to detect the boundary portion, correction can be made in the same manner. For example, the Prewitt filter can be represented by Expression 5.

$$h_x = \begin{bmatrix} -1 & 0 & 1 \\ -1 & 0 & 1 \\ -1 & 0 & 1 \end{bmatrix}, h_y = \begin{bmatrix} -1 & -1 & -1 \\ 0 & 0 & 0 \\ 1 & 1 & 1 \end{bmatrix} \quad \text{(Expression 5)}$$

The $h_x$ provides a first derivative in the vertical direction, and the $h_y$ provides a first derivative in the vertical direction. By arithmetically operating $h_x$ and $h_y$ for the respective pixels, the boundary portion can be detected. To the thus obtained boundary portion, correction amounts which are proportional to $h_x$ and $h_y$ are provided in stages with the boundary portion therebetween.

The present invention can be applied to the self-emission type display, such as the organic EL display and the plasma display, in which each pixel emits light.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-180212, filed Jul. 10, 2008, which is hereby incorporated by reference herein in its entirety.

What is claimed is:

1. A display apparatus comprising:

a plurality of pixels disposed in a matrix pattern, each of the pixels emitting light;

an acquisition unit for acquiring degradation characteristics of an emission luminance of each pixel from a video signal or a signal output from the pixel;

a detection unit for detecting a boundary of pixels showing different degradation characteristics of the plurality of pixels based on the degradation characteristics acquired by the acquisition unit;

a calculation unit for calculating a correction amount of the video signal to the pixels in a periphery of the boundary such that the emission luminance is gently varied in the periphery of the boundary when the plurality of pixels in the periphery of the boundary detected by the detection unit are caused to emit light with a same video signal; and a correction unit for correcting the video signal based on the correction amount calculated by the calculation unit, wherein a video image is displayed by the plurality of pixels based on the corrected video signal.

2. The display apparatus according to claim 1, wherein the detection unit is a circuit that arithmetically operates, for each of the pixels, a difference in the degradation characteristics from an adjacent one of the pixels.

3. The display apparatus according to claim 1, wherein the detection unit is a circuit that arithmetically operates a second derivative of the degradation characteristics between pixels adjacent to each other.

4. The display apparatus according to claim 1, wherein the plurality of pixels include a pixel for emitting red light, a pixel for emitting green light, and a pixel for emitting blue light, and the acquisition unit, the correction unit, the detection unit, and the calculation unit are provided with respect to at least one of the red, green, and blue emission colors.

5. The display apparatus according to claim 1, wherein the acquisition unit, the correction unit, the detection unit, and the calculation unit are provided only with respect to a part of a pixel region comprising the plurality of pixels.

6. A driving method of driving a display apparatus that comprises a plurality of pixels and displays a video image using the plurality of pixels, with each of the plurality of pixels emitting light and the plurality of pixels being disposed in a matrix pattern, the method comprising:

an acquisition step of acquiring degradation characteristics of an emission luminance of each pixel from a video signal or a signal output from the pixel;

a detection step of detecting a boundary of pixels showing different degradation characteristics of the plurality of pixels based on the acquired degradation characteristics;

a calculation step of calculating a correction amount of the video signal to the pixels in a periphery of the boundary such that the emission luminance is gently varied in the periphery of the boundary when the plurality of pixels in the periphery of the detected boundary are caused to emit light with a same video signal;

a correction step of correcting the video signal based on the calculated correction amount; and a display step of displaying the video image in the plurality of pixels based on the corrected video signal.

7. The driving method according to claim 6, wherein some pixels of the plurality of pixels constitute a fixed pattern display region in which a constant image is displayed, and the detection step and the calculation step are performed only for the pixels provided in the fixed pattern display region.

* * * * *